US009175887B2

(12) United States Patent
Lau

(10) Patent No.: US 9,175,887 B2
(45) Date of Patent: Nov. 3, 2015

(54) AIR CONDITIONED HEADGEAR AND AIR CONDITIONED CLOTHING

(71) Applicant: Ming Kin Lau, Hong Kong (HK)

(72) Inventor: Ming Kin Lau, Hong Kong (HK)

( * ) Notice: Subject to any disclaimer, the term of this patent is extended or adjusted under 35 U.S.C. 154(b) by 224 days.

(21) Appl. No.: 14/103,823

(22) Filed: Dec. 11, 2013

(65) Prior Publication Data

US 2014/0238044 A1 Aug. 28, 2014

(30) Foreign Application Priority Data

Feb. 26, 2013 (HK) ..... 13102429.2

(51) Int. Cl.
*F25B 21/02* (2006.01)
*A42B 1/00* (2006.01)
*A41D 13/005* (2006.01)

(52) U.S. Cl.
CPC ..... *F25B 21/02* (2013.01); *A42B 1/008* (2013.01); *A41D 13/0053* (2013.01); *F25B 2321/0212* (2013.01); *F25B 2700/2107* (2013.01)

(58) Field of Classification Search
CPC ..... A42B 1/008; F25B 21/02; G06F 1/20
See application file for complete search history.

(56) References Cited

U.S. PATENT DOCUMENTS

2004/0086008 A1* 5/2004 Gregory ..... H05B 33/0842 372/34
2008/0271463 A1* 11/2008 Chen ..... G01K 17/00 62/3.7
2010/0198322 A1* 8/2010 Joseph ..... A61F 7/007 607/108

* cited by examiner

*Primary Examiner* — Albert Wang

(57) ABSTRACT

The present invention provides an air conditioned headgear and clothing. The headgear includes a thermoelectric cooling module and a control chip. The control chip includes a power supply circuit to supply driving current to the thermoelectric cooling module. The inner temperature of the headgear, the temperature of a heat sink, and the environmental temperature are sensed. A microcontroller of the control chip controls the power supply circuit to provide the driving current to the thermoelectric cooling module via processing the inner temperature of the headgear, a preset temperature, the temperature of the heat sink, and the environmental temperature using the PID control. In the present invention, the temperature is controlled using the PID control, thus wide fluctuations of the temperature is avoided, energy can be used effectively, and thermal cycle can be avoided.

10 Claims, 4 Drawing Sheets

AIR CONDITIONED HEADGEAR AND AIR CONDITIONED CLOTHING

CROSS-REFERENCE TO RELATED APPLICATIONS

This present application claims the benefit of Hong Kong short-term Patent Application No. 13102429.2 filed on Feb. 26, 2013; the content of which is hereby incorporated by reference.

BACKGROUND

1. Technical Field

The present invention relates to special working gears, and particularly, to an air conditioned headgear and an air conditioned clothing.

2. Description of Related Art

A conventional cooling headgear having a thermoelectric cooling module usually employs a thermo sensitive switch to control the temperature of the headgear, which may result in wide fluctuations of temperature, and easily result in energy loss and uncomfort. And the fluctuations also make the thermoelectric cooling module having frequent reverse currents, hence reduces the lifespan of thermoelectric cooling module.

Another problem when using the thermoelectric cooling module, is that the heat have to be dissipated in time. Otherwise the thermoelectric cooling module would not function. To resolve this, a huge heat sink or even fan would be used to maintain a "more than required" heat dissipation efficiency, which increases the weight of the headgear, and cause uncomfort to user wearing the headgear.

Therefore, there is a perspective for improvement in the art.

SUMMARY

Embodiments of the present invention relate to an air conditioned headgear using the PID (proportional-integral-differential, PID) control to overcome the shortcomings caused by the conventional cooling headgear.

The air conditioned headgear includes a heat sink, a thermoelectric cooling module, and a control circuit. The heat sink is exposed out of the headgear. The thermoelectric cooling module includes a cooling surface, a heating surface, and a conduction cooling element. The cooling surface and the conduction cooling element are arranged in the interior of the headgear. The heating surface is connected to the heat sink. The control circuit includes a power supply circuit, a first temperature sensor, a second temperature sensor, a third temperature sensor, and a microcontroller. The power supply circuit is to supply driving current to the thermoelectric cooling module. The first temperature sensor is to sense the inner temperature of the headgear. The second temperature sensor is to sense the temperature of the heat sink. The third temperature sensor is to sense the environmental temperature. The microcontroller controls the driving current to the thermoelectric cooling module via processing the inner temperature of the headgear, a preset temperature, the temperature of the heat sink, and the environmental temperature using the PID control.

Wherein, the microcontroller includes a first subtractor, a second subtractor, a PID module, and a PD (proportional-differential, PD) module, a first weight accumulator, a second weight accumulator, and a determining module. The first subtractor is to determine a first temperature difference between the inner temperature of the headgear and the preset temperature. The second subtractor is to determine a second temperature difference between the temperature of the heat sink and the environmental temperature. The PID module is to use the PID control to process the first temperature difference to generate a PID result, the PD module is to use the PD control to process the second temperature difference to generate a PD result. The first weight accumulator is to process the PID result based on weighted accumulative operation to determine a first current. The second weight accumulator is to process the PD result based on the weighted accumulative operation to determine an upper limit of current. The determining module is to compare the first current with the upper limit of current to determine the driving current applied to the thermoelectric cooling module.

Wherein, the first weight accumulator and the second weight accumulator employs a dynamic weighted method.

Wherein, the thermoelectric cooling module, the power supply circuit, and the microcontroller are arranged on a forehead of the headgear.

Wherein, the conduction cooling element comprises a graphite cloth.

Wherein, the graphite cloth extends from the forehead of the headgear to other region of the headgear.

Wherein, the power supply circuit includes a lithium battery and a current control circuit connected to the thermoelectric cooling module. The current control circuit not only controls the amount of current, but also the current direction to the thermoelectric cooling module.

Embodiments of the present invention further relate to an air conditioned clothing. An enclosed environment is formed when a user wears the clothing. The clothing includes a heat sink, a thermoelectric cooling module, and a control circuit. The heat sink is exposed out of the clothing. The thermoelectric cooling module includes a cooling surface, a heating surface, and a conduction cooling element. The cooling surface and the conduction cooling element are arranged in the interior of the clothing. The heating surface is connected to the heat sink. The control circuit includes a power supply circuit, a first temperature sensor, a second temperature sensor, a third temperature sensor, and a microcontroller. The power supply circuit is to supply driving current to the thermoelectric cooling module. The first temperature sensor is to sense the temperature of the enclosed environment. The second temperature sensor is to sense the temperature of the heatsink. The third temperature sensor is to sense the environmental temperature. The microcontroller controls the driving current to the thermoelectric cooling module via processing the temperature of the headgear enclosed environment, a preset temperature, the temperature of the heat sink, and the environmental temperature using the PID control.

Wherein, the conduction cooling element comprises a graphite cloth.

In the present invention, the heat dissipation efficiency is determined by monitoring the temperature difference between the temperature of the heat sink and the environmental temperature. The heat dissipation efficiency is fed back to the temperature control system, to determine a current limit to the system, avoiding overheat of the heat sink. The temperature is controlled using the PID control, this reduces the overshoots. Thus wide fluctuations of the temperature is avoided, energy can be used effectively. Also less thermal cycles happen.

In the present invention, the lithium battery is used to power the thermoelectric cooling module, and the microcontroller is employed, thus a clean, safe, durable, environment friendly, comfortable, and convenient portable temperature control device can be made. As the operation temperature of the thermoelectric cooling module is centralized in the center of the heat sink, to make a user wearing the headgear to be able to feel the preset temperature, the heat should be conducted well, and spread evenly to the whole closed space of the headgear. The graphite cloth is light and soft with good heat conductivity, thus the graphite is better for clothes and ornaments than metal. When a user wears the headgear, a closed space is formed around the head of the user, preventing unwanted heat exchange to the environment. The temperature of the thermoelectric cooling module is controlled by the driving current which is determined according to the PID control, thus providing a quick response, avoiding uncomfort generated by wide fluctuations of temperature.

In this embodiment, the small and light heat sink is employed without any fan, making the headgear to be quiet, durable (no mechanical moving parts) and energy saving. In this embodiment, the temperature control system can be adjusted to adapt the heat sink efficiency, thus different design of heat sinks can be used in the headgear. Therefore, the heat sink with high efficiency and pleasing shape can be used in the headgear.

In the present invention, a current control circuit is used to control the current direction to the thermoelectric cooling module, thus the thermoelectric cooling module is equipped with both cooling function and heating function. Therefore, the headgear can be used in both hot time and cold time, and forming a complete temperature control solution.

The following detailed description, together with the accompanying drawings will provide a better understanding of the nature and advantages of the present invention.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts through out the several views.

DETAILED DESCRIPTION

The disclosure is illustrated by way of example and not by way of limitation in the figures of the accompanying drawings in which like reference indicate similar elements. It should be noted that reference to "an" or "one" embodiment in the disclosure are not necessarily to the same embodiment, and such references mean "at least one".

Figure 1:
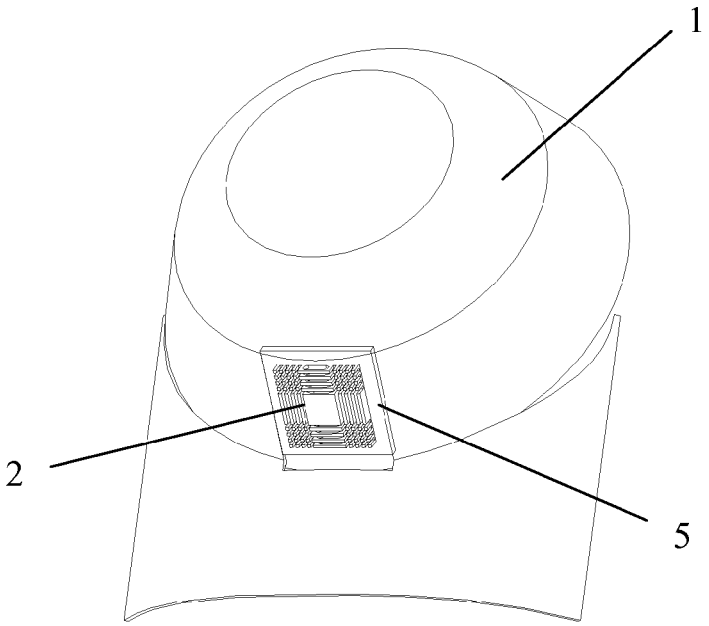
FIG. 1 is an isometric view of an air conditioned headgear, in accordance with an exemplary embodiment.
Figure 2:
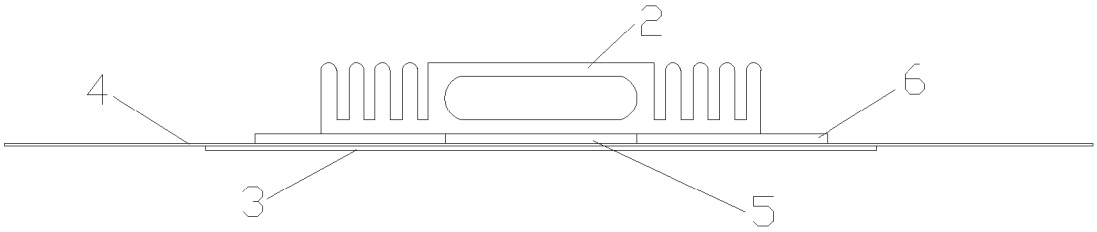
FIG. 2 is a schematic view showing how to mount a thermoelectric cooling module of the air conditioned headgear of FIG. 1, in accordance with an exemplary embodiment.

FIGS. 1-2 show an embodiment of an air conditioned headgear 1 (hereinafter, headgear 1). The forehead of the headgear includes a thermoelectric cooling module 5 and a control circuit 7 (see FIG. 3). The thermoelectric cooling module 5 is secured to the headgear 1 via a mounting hole (not shown) of a forehead panel 3 of the headgear 1. The detail mounting process is that a cooling surface of a conduction cooling element 4 of the thermoelectric cooling module 5 is arranged in the interior of the headgear 1. A heating surface of the thermoelectric cooling module 5 is connected to a heat sink 2, and the heat sink 2 is exposed out of the headgear 1. An insulated layer 6 is arranged between the heat sink 2 and the conduction cooling element 4. In this embodiment, the conduction cooling element 4 includes a graphite cloth. The graphite cloth may extend from the forehead of the headgear 1 to a top of the headgear 1, or extend from a brim of the headgear 1 to a rear of the headgear 1. As the operation temperature of the thermoelectric cooling module 5 is centralized in the center of the heat sink 2, to make a user wearing the headgear 1 to feel comfortable, the heat should be conducted well, and spread evenly to the whole closed space of the headgear 1. The graphite cloth is light and soft with good heat conductivity, thus the graphite is better for clothes and ornaments than metal.

Figure 3:
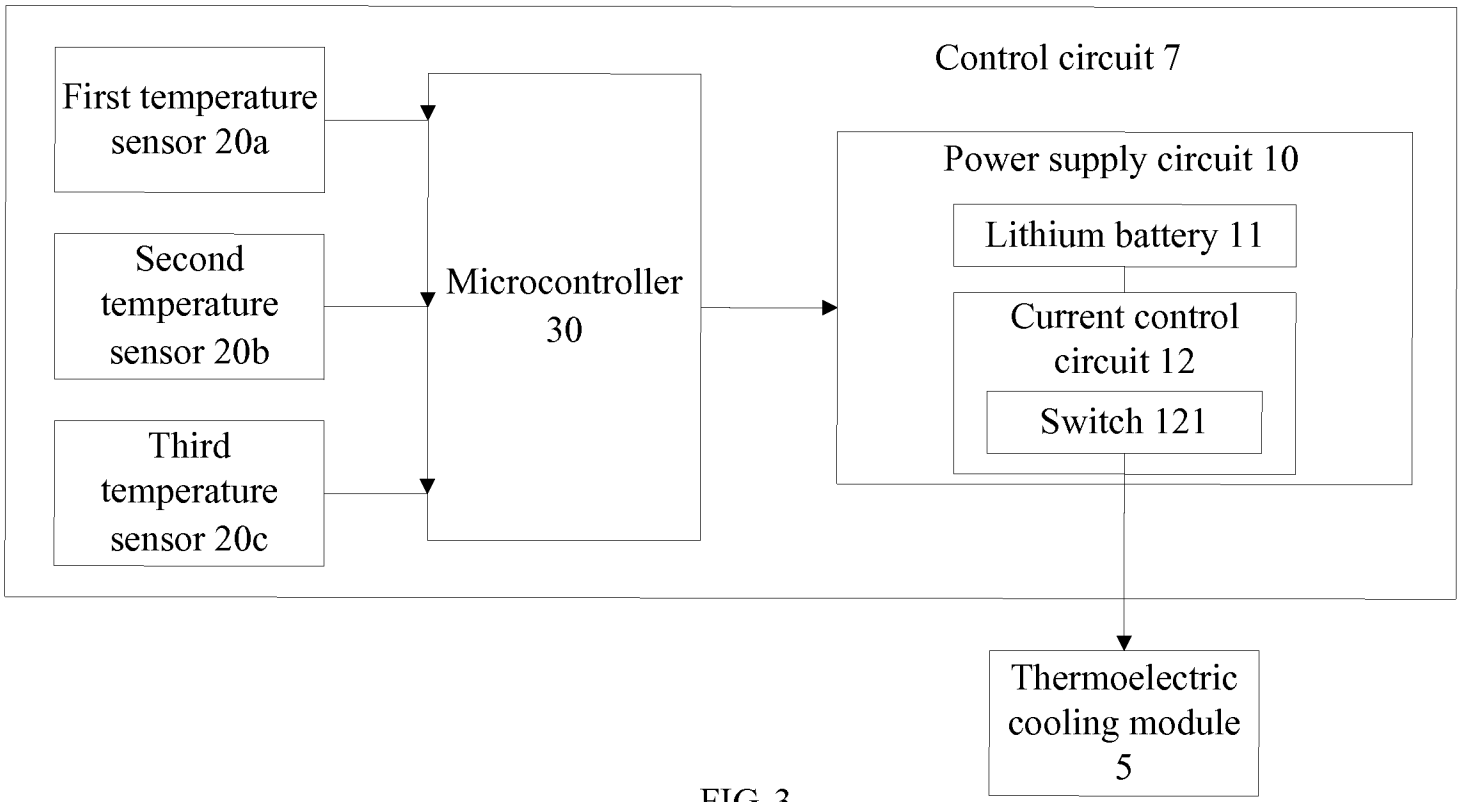
FIG. 3 is a block diagram of a control circuit of the air conditioned headgear of FIG. 1, in accordance with an exemplary embodiment.

FIG. 3 shows an embodiment of the control circuit 7. The control circuit 7 includes a power supply circuit 10, a first temperature sensor 20*a*, a second temperature sensor 20*b*, a third temperature sensor 20*c*, and a microcontroller 30. The power supply circuit 10 provides driving current to the thermoelectric cooling module 4. The first temperature sensor 20*a* is arranged in the interior of the headgear 1 and employed to sense the inner temperature of the headgear 1. The second temperature sensor 20*b* is arranged on the heat sink 2 and employed to sense the temperature of the heat sink 2. The third temperature sensor 20*c* is arranged on the exterior of the headgear 1 and employed to sense the environment temperature. The microcontroller 30 controls the power supply circuit 10 to provide the driving current to the thermoelectric cooling module 5 via processing the inner temperature of the headgear 1, a preset temperature, the temperature of the heat sink 2, and the environmental temperature using PID (proportional-integral-differential, PID) control.

Figure 4:
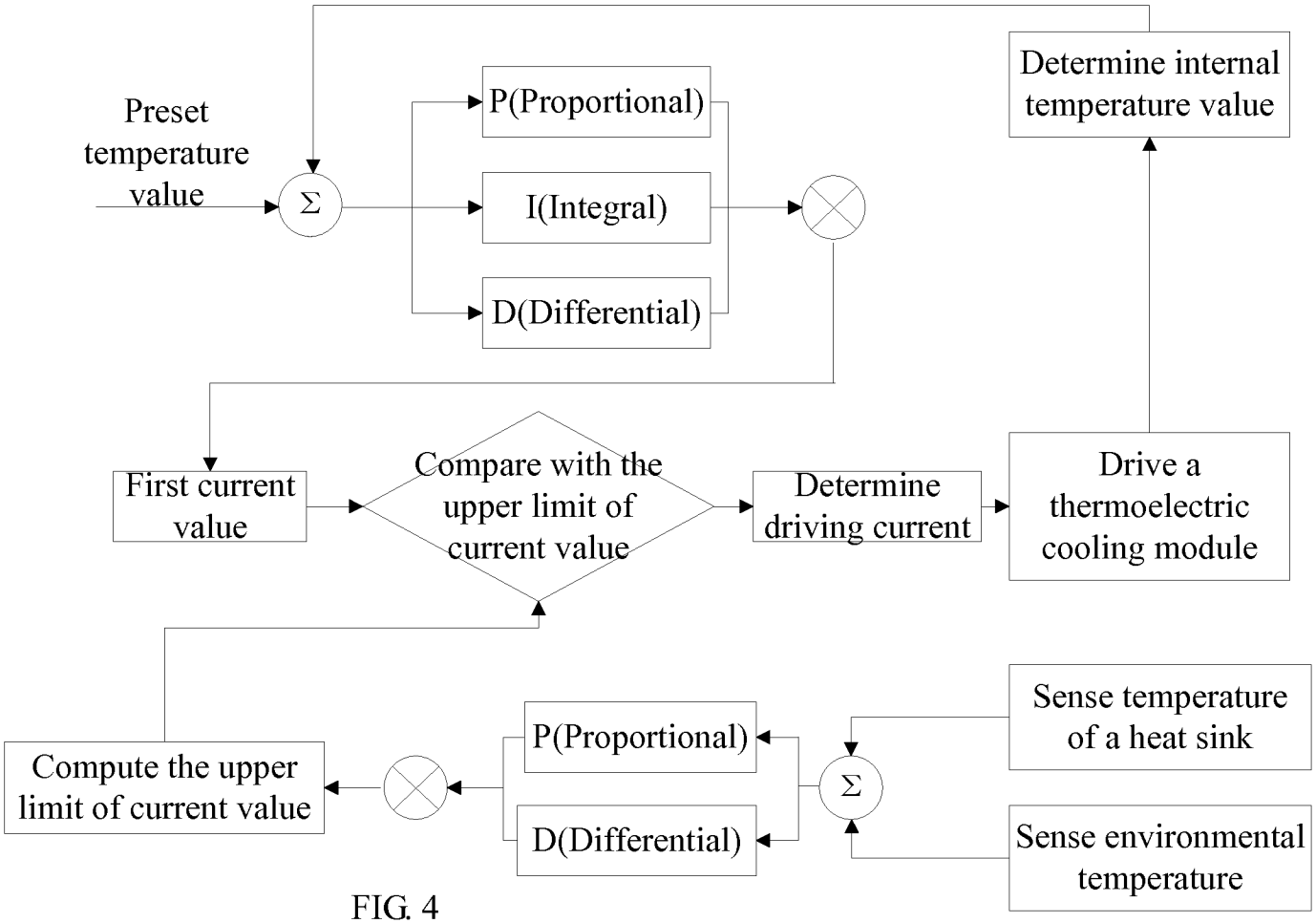
FIG. 4 is a block diagram of a microcontroller of the air conditioned headgear of FIG. 1, in accordance with an exemplary embodiment.

FIG. 4 shows an embodiment of a microcontroller 30 of the headgear 1. The microcontroller 30 includes a first subtractor 31, a second subtractor 37, a PID module 32, and a PD (proportional-differential, PD) module 36, a first weight accumulator 33, a second weight accumulator 35, and a determining module 34. The first subtractor 31 determines a first temperature difference between the inner temperature of the headgear 1 and the preset temperature. The second subtractor 32 determines a second temperature difference between the temperature of the heat sink 2 and the environmental temperature. The PID module 32 uses the PID control to process the first temperature difference to generate a PID result. The PD module 36 uses the PD control to process the second temperature difference to generate a PD result. The first weight accumulator 33 processes the PID result based on weighted accumulative operation to determine a first current. The second weight accumulator 35 processes the PD result based on the weighted accumulative operation to determine an upper limit of current. The determining module 34 compares the first current with the upper limit of current to determine the driving current applied to the thermoelectric cooling module 5.

In this embodiment, the cooling efficiency of the thermoelectric cooling module 5 is controlled by the driving current which is determined according to the PID control, thus the thermoelectric cooling module 5 has a quick response, avoiding uncomfort generated by wide fluctuations of temperature. The heat dissipation efficiency is determined by monitoring the temperature difference between the temperature of the heat sink 2 and the environmental temperature. The heat dissipation efficiency is fed back to the temperature control system of the headgear 1, to avoid overheat of the heat sink 2. The temperature of the headgear 1 is controlled using the PID control, thus wide fluctuations of the temperature is avoided, energy can be used effectively, and thermal cycle can be avoided.

In this embodiment, the dynamic weighted method is employed. For example, the change of the sensed temperature is compared with a reference range. When the sensed temperature does not fall within the reference range, the weighted value is changed.

In this embodiment, the power supply circuit 10 includes a lithium battery 11 and a current control circuit 12 connected to the lithium battery 11. The current control circuit 12 includes a switch 121 to control the current direction to the thermoelectric cooling module 5.

In this embodiment, the lithium battery 11 is used to power the thermoelectric cooling module 5, and the microcontroller 30 is employed, thus a clean, safe, durable, environment friendly, comfortable, and convenient portable temperature control device can be made and can be used in a coat. The switch 121 is used to control the current direction to the thermoelectric cooling module 5, thus the thermoelectric cooling module 5 is equipped with both cooling function and heating function. Thus, the headgear 1 can be used in both hot time and cold time, and can make the user wearing the headgear 1 to feel comfortable at any time.

The thermoelectric cooling module 5, the power supply circuit 10, and the microcontroller 30 are arranged on the forehead of the headgear 1. The microcontroller 30 and the lithium battery 11 can be arranged on other parts of the headgear 1, and can be detached from the headgear 1, thus it is easy to clean the headgear 1.

When a user wears the headgear 1, a closed space is formed around the head of the user, thus preventing unwanted heat exchange to the environment. In this embodiment, a small and light heat sink 2 is employed without any fan, making the headgear 1 to be quiet, durable and energy saving.

In this embodiment, the temperature control system can be adjusted to adapt the heat sink 2, thus different heat sink designs can be used in the headgear 1. Thus, the heat sink 2 with high efficiency and pleasing shape can be used in the headgear 1.

The thermoelectric cooling module 5 and the control circuit 7 can be used in clothing and trousers, to form an air conditioned clothing and an air conditioned trousers, which can be used in special work, for example, working in the high altitude and cold zone or high altitude and hot zone, or enclosed area without air-conditioning.

Figure 5:
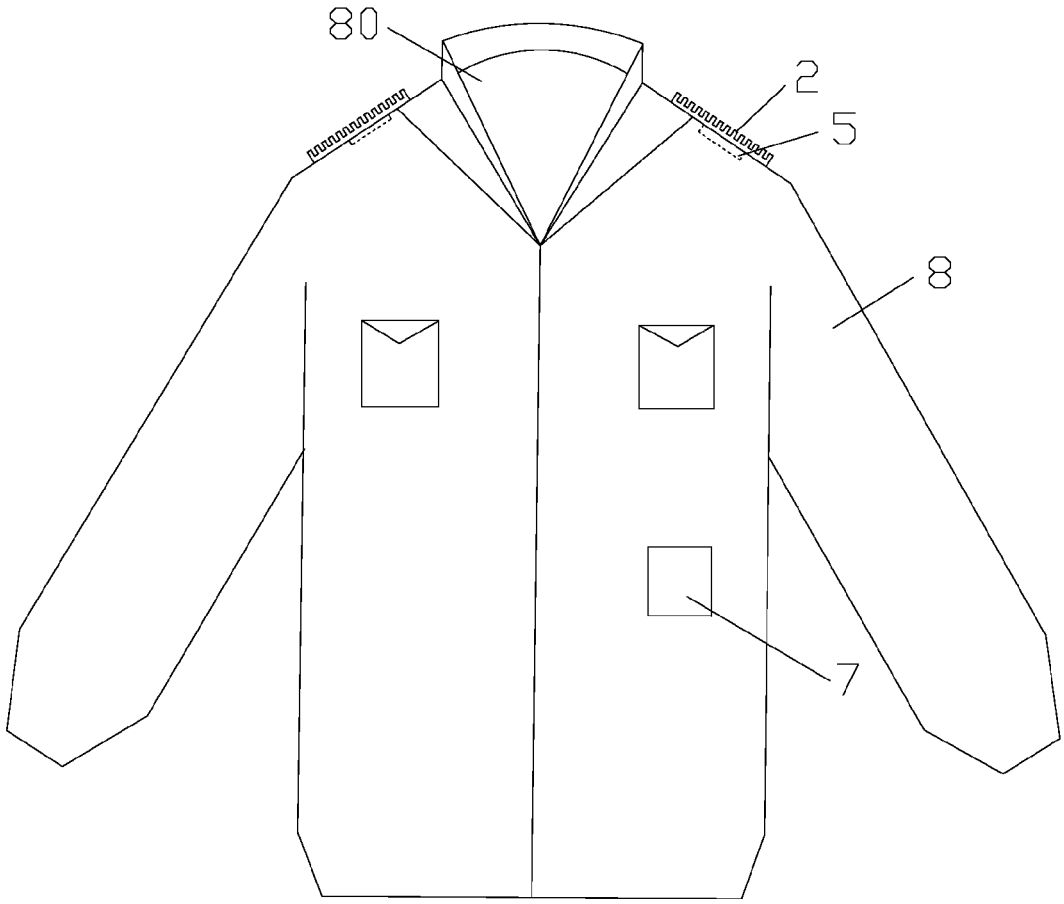
FIG. 5 is a front view of an air conditioned clothing, in accordance with an exemplary embodiment.

As shown in FIG. 5, an air conditioned clothing 8 in accordance with an exemplary embodiment of the present invention is disclosed. The air conditioned clothing 8 includes a heat sink 2, a thermoelectric cooling modules 5 and a control circuit 7. The heat sink 2 is exposed out of the air conditioned clothing 8.

Figure 6:
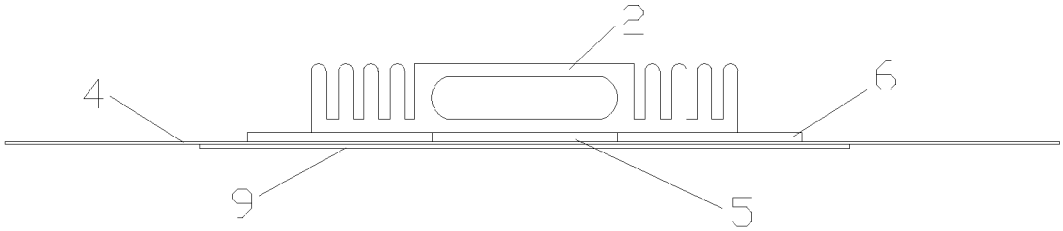
FIG. 6 is a schematic view showing how to mount a thermoelectric cooling module of the air conditioned clothing of FIG. 5, in accordance with an exemplary embodiment.

Referring to FIG. 6, the thermoelectric cooling module 5 may be secured to the air conditioned clothing 8 via a mounting hole (not shown) of a panel 9 of the air conditioned clothing 8. The detail mounting process may be that a cooling surface of a conduction cooling element 4 of the thermoelectric cooling module 5 is arranged in the interior of the air conditioned clothing 8. A heating surface of the thermoelectric cooling module 5 may be connected to a heat sink 2, and the heat sink 2 may be exposed out of the air conditioned clothing 8. An insulated layer 6 may be arranged between the heat sink 2 and the conduction cooling element 4. In this embodiment, the conduction cooling element 4 may include a graphite cloth.

As shown in FIG. 3, the control circuit 7 may include a power supply circuit 10, a first temperature sensor 20*a*, a second temperature sensor 20*b*, a third temperature sensor 20*c*, and a microcontroller 30. The power supply circuit 10 may provide driving current to the thermoelectric cooling module 4. The first temperature sensor 20*a* may be arranged in the interior of the air conditioned clothing 8 and employed to sense the inner temperature of the air conditioned clothing 8. The second temperature sensor 20*b* may be arranged on the heat sink 2 and employed to sense the temperature of the heat sink 2. The third temperature sensor 20*c* may be arranged on the exterior of the air conditioned clothing 8 and employed to sense the environment temperature. The microcontroller 30 may control the power supply circuit 10 to provide the driving current to the thermoelectric cooling module 5 via processing the inner temperature of the air conditioned clothing 8, a preset temperature, the temperature of the heat sink 2, and the environmental temperature using PID (proportional-integral-differential, PID) control.

As shown in FIG. 4, the microcontroller 30 may include a first subtractor 31, a second subtractor 37, a PID module 32, and a PD (proportional-differential, PD) module 36, a first weight accumulator 33, a second weight accumulator 35, and a determining module 34. The first subtractor 31 determines a first temperature difference between the inner temperature of the air conditioned clothing 8 and the preset temperature. The second subtractor 32 determines a second temperature difference between the temperature of the heat sink 2 and the environmental temperature. The PID module 32 uses the PID control to process the first temperature difference to generate a PID result. The PD module 36 uses the PD control to process the second temperature difference to generate a PD result. The first weight accumulator 33 processes the PID result based on weighted accumulative operation to determine a first current. The second weight accumulator 35 processes the PD result based on the weighted accumulative operation to determine an upper limit of current. The determining module 34 compares the first current with the upper limit of current to determine the driving current applied to the thermoelectric cooling module 5.

In this embodiment, the cooling efficiency of the thermoelectric cooling module 5 may be controlled by the driving current which is determined according to the PID control, thus the thermoelectric cooling module 5 has a quick response, avoiding uncomfort generated by wide fluctuations of temperature. The heat dissipation efficiency may be determined by monitoring the temperature difference between the temperature of the heat sink 2 and the environmental temperature. The heat dissipation efficiency is fed back to the temperature control system of the air conditioned clothing 8, to avoid overheat of the heat sink 2. The temperature of the air conditioned clothing 8 may be controlled using the PID control, thus wide fluctuations of the temperature is avoided, energy can be used effectively, and thermal cycle can be avoided.

In this embodiment, the dynamic weighted method is employed. For example, the change of the sensed temperature is compared with a reference range. When the sensed temperature does not fall within the reference range, the weighted value is changed.

In this embodiment, the power supply circuit 10 may include a lithium battery 11 and a current control circuit 12 connected to the lithium battery 11. The current control circuit 12 may include a switch 121 to control the current direction to the thermoelectric cooling module 5.

In this embodiment, the lithium battery 11 may be used to power the thermoelectric cooling module 5, and the microcontroller 30 is employed, thus a clean, safe, durable, environment friendly, comfortable, and convenient portable temperature control device can be made and can be used in a coat. The switch 121 is used to control the current direction to the thermoelectric cooling module 5, thus the thermoelectric cooling module 5 is equipped with both cooling function and heating function. Thus, the air conditioned clothing 8 can be used in both hot time and cold time, and can make the user wearing the air conditioned clothing 8 to feel comfortable at any time.

The thermoelectric cooling module 5, the power supply circuit 10, and the microcontroller 30 may be arranged on the top of the air conditioned clothing 8. The microcontroller 30 and the lithium battery 11 can be arranged on other parts of the air conditioned clothing 8, and can be detached from the air conditioned clothing 8, thus it is easy to clean the air conditioned clothing 8.

When a user wears the air conditioned clothing 8, an enclosed environment 80 is formed around the body of the user, thus preventing unwanted heat exchange to the environment. In this embodiment, a small and light heat sink 2 is employed without any fan, making the air conditioned clothing 8 to be quiet, durable and energy saving.

In this embodiment, the temperature control system can be adjusted to adapt the heat sink 2, thus different heat sink designs can be used in the air conditioned clothing 8. Thus, the heat sink 2 with high efficiency and pleasing shape can be used in the air conditioned clothing 8.

Although information as to, and advantages of, the present embodiments have been set forth in the foregoing description, together with details of the structures and functions of the present embodiments, the disclosure is illustrative only; and changes may be made in detail, especially in the matters of Shape, size, and arrangement of parts within the principles of the present embodiments to the full extent indicated by the broad general meaning of the terms in which the appended claims are expressed.

What is claimed is:

1. An air conditioned headgear comprising:

a heat sink exposed out of the headgear;

a thermoelectric cooling module comprising a cooling surface, a heating surface, and a conduction cooling element, wherein, the cooling surface and the conduction cooling element are arranged in an interior of the headgear, the heating surface is connected to the heat sink; and a control circuit comprising a power supply circuit, a first temperature sensor, a second temperature sensor, a third temperature sensor, and a microcontroller, wherein, the power supply circuit is to supply driving current to the thermoelectric cooling module, the first temperature sensor is to sense the inner temperature of the headgear, the second temperature sensor is to sense the temperature of the heat sink, the third temperature sensor is to sense the environmental temperature, the microcontroller is to control the power supply circuit to provide the driving current to the thermoelectric cooling module via processing the inner temperature of the headgear, a preset temperature, the temperature of the heat sink, and the environmental temperature using proportional-integral-differential control.

2. The headgear as described in claim 1, wherein the microcontroller comprises a first subtractor, a second subtractor, a proportional-integral-differential module, and a proportional-differential module, a first weight accumulator, a second weight accumulator, and a determining module, the first subtractor is to determine a first temperature difference between the inner temperature of the headgear and the preset temperature, the second subtractor is to determine a second temperature difference between the temperature of the heat sink and the environmental temperature, the proportional-integral-differential module is to use the proportional-integral-differential control to process the first temperature difference to generate a proportional-integral-differential result, the proportional-differential module is to use the proportional-differential control to process the second temperature difference to generate a proportional-differential result, the first weight accumulator is to process the proportional-integral-differential result based on weighted accumulative operation to determine a first current, the second weight accumulator is to process the proportional-differential result based on the weighted accumulative operation to determine an upper limit of current, the determining module is to compare the first current with the upper limit of current to determine the driving current applied to the thermoelectric cooling module.

3. The headgear as described in claim 2, wherein the first weight accumulator and the second weight accumulator employ a dynamic weighted method.

4. The headgear as described in claim 2, wherein the thermoelectric cooling module, the power supply circuit, and the microcontroller are arranged on a forehead of the headgear.

5. The headgear as described in claim 4, wherein the conduction cooling element comprises a graphite cloth.

6. The headgear as described in claim 5, wherein the graphite cloth extends from the forehead of the headgear to other regions of the headgear.

7. The headgear as described in claim 6, wherein the power supply circuit comprises a lithium battery and a current control circuit connected to the lithium battery, the current control circuit comprises a switch to control the current direction to the thermoelectric cooling module.

8. An air conditioned clothing, an enclosed environment formed when a user wears the clothing, the clothing comprising:

a heat sink exposed out of the clothing;

a thermoelectric cooling module comprising a cooling surface, a heating surface, and a conduction cooling element, wherein, the cooling surface and the conduction cooling element are arranged in an interior of the clothing, the heating surface is connected to the heat sink; and a control circuit comprising a power supply circuit, a first temperature sensor, a second temperature sensor, a third temperature sensor, and a microcontroller, wherein, the power supply circuit is to supply driving current to the thermoelectric cooling module, the first temperature sensor is to sense the temperature of the enclosed environment, the second temperature sensor is to sense the temperature of the heat sink, the third temperature sensor is to sense the environmental temperature, the microcontroller is to control the power supply circuit to provide the driving current to the thermoelectric cooling module via processing the temperature of the enclosed environment, a preset temperature, the temperature of the heat sink, and the environmental temperature using proportional-integral-differential control.

9. The clothing as described in claim 8, wherein the micro controller comprises a first subtractor, a second subtractor, a proportional-integral-differential module, and a proportional-differential module, a first weight accumulator, a second weight accumulator, and a determining module, the first subtractor is to determine a first temperature difference between the temperature of the enclosed environment and the preset temperature, the second subtractor is to determine a second temperature difference between the temperature of the heat sink and the environmental temperature, the proportional-integral-differential module is to use the proportional-integral-differential control to process the first temperature difference to generate a proportional-integral-differential result, the proportional-differential module is to use the proportional-differential control to process the second temperature difference to generate a proportional-differential result, the first weight accumulator is to process the proportional-integral-differential result based on weighted accumulative operation to determine a first current, the second weight accumulator is to process the proportional-differential result based on the weighted accumulative operation to determine an upper limit of current, the determining module is to compare the first current with the upper limit of current to determine the driving current applied to the thermoelectric cooling module.

10. The clothing as described in claim 9, wherein the conduction cooling element comprises a graphite cloth.

* * * * *